US005139170A

United States Patent [19]

Bullock

[11] Patent Number: 5,139,170

[45] Date of Patent: Aug. 18, 1992

[54] DISPENSING APPARATUS FOR MULTIPLE FLUIDS

[75] Inventor: Richard E. Bullock, Charlotte, Mich.

[73] Assignee: Ad-Tech Plastic Systems Corp., Charlotte, Mich.

[21] Appl. No.: 578,749

[22] Filed: Sep. 6, 1990

[51] Int. Cl.[5] ..... B67D 5/52

[52] U.S. Cl. ..... 222/137; 222/255; 222/262; 222/309

[58] Field of Search ..... 222/145, 136, 137, 400.5, 222/401, 309, 262, 255, 325

[56] References Cited

U.S. PATENT DOCUMENTS

| | | | |
|---|---|---|---|
| Re. 31,934 | 7/1985 | Marston | 222/181 |
| 1,521,014 | 12/1924 | Draver . | |
| 2,271,767 | 2/1942 | Hummel | 107/1 |
| 2,946,488 | 7/1960 | Kraft | 222/134 |
| 3,207,376 | 9/1965 | Molitor | 222/129.3 |
| 3,403,818 | 10/1968 | Enssle | 222/23 |
| 3,409,174 | 11/1968 | Radcliffe et al. | 222/70 |
| 3,547,316 | 12/1970 | Heiskell | 222/82 |
| 3,604,057 | 9/1971 | Nixdorff, Jr. | 18/30 FH |
| 3,642,175 | 2/1972 | Robbins | 222/135 |
| 3,814,289 | 6/1974 | Robbins | 222/135 |
| 3,843,023 | 10/1974 | Vroom | 222/136 |
| 3,880,324 | 4/1975 | Roesel et al. | 222/82 |
| 3,957,176 | 5/1976 | Marston | 222/185 |
| 4,027,785 | 6/1977 | Edstrom et al. | 222/135 |
| 4,033,480 | 7/1977 | Di Maio | 222/129 |
| 4,168,018 | 9/1979 | Zahaykevich | 222/82 |
| 4,312,463 | 1/1982 | Daby | 222/134 |
| 4,378,075 | 3/1983 | Voss et al. | 222/137 |
| 4,391,389 | 7/1983 | Catalfamo | 222/135 |
| 4,432,470 | 2/1984 | Sopha | 222/135 |
| 4,577,783 | 3/1986 | Racca et al. | 222/386.5 |
| 4,588,110 | 5/1986 | Nelson et al. | 222/135 |
| 4,634,024 | 1/1987 | Vollenweider | 222/135 |
| 4,693,397 | 9/1989 | Lang | 222/137 |
| 4,765,509 | 8/1988 | Eisenhut et al. | 222/61 |
| 4,881,820 | 11/1989 | Luckhoff | 366/142 |

FOREIGN PATENT DOCUMENTS

| | | | |
|---|---|---|---|
| 3740857 | 6/1989 | Fed. Rep. of Germany | 222/137 |

OTHER PUBLICATIONS

Leaflet entitled "Ad-Tech Plastic Systems Announces 10 Simple Reasons Why our Set-Fast Polyester Resin Cartridge Dispenser is Indispensable"—promotional sheet describing single dispenser for resin on sale in the United States for more than one year prior to the filing of this application.

*Primary Examiner*—Michael S. Huppert
*Assistant Examiner*—Gregory L. Huson
*Attorney, Agent, or Firm*—Price, Heneveld, Cooper, DeWitt & Litton

[57] ABSTRACT

A dispensing apparatus for multiple fluids, and especially epoxy, polyester or other resins and hardeners, includes a base, supports for mounting separate containers of two fluids, and a manually operated metering handle for dispensing predetermined proportioned quantities of the two fluids through first and second outlets upon movement of the handle. First and second measuring assemblies, preferably pistons pivotally connected at spaced locations to the handle, receive fluids from the containers and urge precise quantities of the fluids through the outlets. The position of connection of at least one of the pistons to the handle may be changed to vary the proportion of one fluid dispensed with respect to the other fluid. The position of the support for one of the fluid containers may also be changed to assist in changing the piston engagement with the handle. Preferably, air pressure is applied to each fluid container to aid in dispensing the fluids.

47 Claims, 3 Drawing Sheets

DISPENSING APPARATUS FOR MULTIPLE FLUIDS

BACKGROUND OF THE INVENTION

This invention relates to fluid dispensers and, more particularly, to a dispenser for multiple fluids for which precise, proportionate quantities are needed for subsequent mixing. Specifically, the invention relates to a dispenser for chemically reactive resins and hardeners which must be mixed to produce fillers, adhesives, putties, or laminating, potting and molding compounds for use in various industrial or other applications.

It is well-known to mix various types of resins and catalysts or hardeners in correct proportions to yield compounds which undergo chemical reactions and later cure and harden after application. Such compounds include polyester, urethane or epoxy fillers, adhesives, putties, laminating, potting and molding compounds used for filling auto bodies, boat hulls and the like. Many such materials require a ratio of 1-2% hardener to resin by volume depending on the specific materials desired. In the past, users of such materials had difficulty in controlling the proportions and quantities of the ingredients. Usually such ingredients are sold in bulk containers from which the materials had to be dipped or poured into suitable mixing containers. Such methods are messy, wasteful and often resulted in improperly measured quantities which, when mixed, provided less than adequate filler, adhesive or molding compounds. In addition, in high volume, rapid application industrial uses, difficulties have been encountered when changing materials since the proportion of resin to hardener varies with different materials and workers often confuse the amounts of one type of material needed with respect to another.

Previous attempts to provide dispensers for multiple fluids, and especially resins and hardeners, have failed to meet the various needs for industrial and other applications as noted above. For example, U.S. Pat. Nos. 3,547,316, 4,033,480, 4,378,075 and 4,391,389 all disclose apparatus for dispensing predetermined quantities of multiple fluids However, these dispensers fail to provide any type of adjustment to vary the proportions of one fluid to another when different fluids are used, fail to provide for pressurized flow from bulk containers making them less than desirable for high volume use, or were difficult to adjust and inconvenient to use, especially with different types of materials.

Accordingly, a need has remained for a reliable dispenser for proportioned amounts of multiple fluids which is easily adjustable to vary the fluid proportions, is reliable and easily used with different materials, and improves quality control in various applications such as auto body and boat hull repair and manufacture and the like.

SUMMARY OF THE INVENTION

The present invention provides apparatus for dispensing multiple fluids in proportion to one another which may be easily adjusted to vary the quantity of one fluid dispensed with respect to the other fluid, thereby allowing use with different types of fluid materials. The apparatus is reliable and, in a preferred embodiment, provides pressure acting on the fluids to be dispensed to enhance uniform release of the materials.

In one form, the dispenser includes a base having first and second fluid outlets, first mounting means for mounting a first fluid container in fluid communication with the first outlet, and second mounting means for mounting a second fluid container in fluid communication with the second outlet. Manually operated metering means on the base dispense predetermined proportioned quantities of the first and second fluids through the first and second outlets. The metering means include a handle movably mounted on the base, and first and second measuring means each connected to the handle and in fluid communication with the respective outlets for measuring and dispensing quantities of the first and second fluids through the first and second outlets upon movement of the handle. Pressure means for applying pressure to the fluids in the first and second containers when mounted on the mounting means to urge fluid from the container to the respective measuring means may also be included. Adjustment means for changing the connection position of at least one of the measuring means to the handle are provided such that the proportion of one of the dispensed fluids to the other may be varied.

In other aspects of the invention, one of the first and second mounting means for mounting fluid containers on the base may include fastening means for securing the one mounting means to the base in different positions with respect to the handle such that the position of engagement of the one mounting means with the handle is adjustable to vary the proportion of one of the dispensed fluids to the other fluid.

Preferably, the manually operated handle is pivotally mounted to the base with the first and second measuring means being pivotally connected to the handle at different distances from the first handle portion. These measuring means may be connected to the handle intermediate the first handle portion and an end of the handle with one of the measuring means being connected at a position closer to the handle pivot than the other.

In other aspects of the invention, the measuring means may include pistons mounted in cylinders which communicate with the fluid containers and the respective outlets, the pistons being slidably mounted and pivotally connected to the handle such that each pushes a predetermined quantity of fluid from its respective opening upon movement of the handle.

The adjustment means may include a series of apertures in the handle for changing the pivotal connection of the measuring means or piston to the handle.

The pressure means may include an air regulator and fluid lines for connecting the air regulator to the fluid cylinders.

Preferably, the fluid cylinder including the hardeners is adjustably mounted on the base and with respect to the other cylinder by the second mounting means so that its position may be changed to accommodate the varying connection positions of its associated measuring means with the manually operated handle.

The dispensing apparatus of the present invention provides numerous advantages over prior known dispensers. First, the apparatus is useful with numerous types of multiple fluid reactant systems typically used in industrial and other applications for fillers, adhesives, molding and laminating compounds, and may be easily adjusted to vary the proportions of one fluid with respect to another such as in the case of hardeners and resins. Bulk fluid containers for the materials are easily mounted and changed on the apparatus while the apparatus is extremely reliable in providing precisely measured uniform quantities of each material which, when mixed, improve the quality of the resultant fillers, adhesives and compounds. The apparatus allows the use of regulated air pressure typically available in industrial settings to enhance fluid flow and quality control. Moreover, the position of one fluid container with respect to the base and the other container is also adjustable to enhance the adjustment of the measuring pistons with the handle. The device is also extremely durable and long-wearing in use.

These and other objects, advantages, purposes and features of the invention will become more apparent from a study of the following description taken in conjunction with the drawings.

DESCRIPTION OF THE PREFERRED EMBODIMENTS

Figure 1:
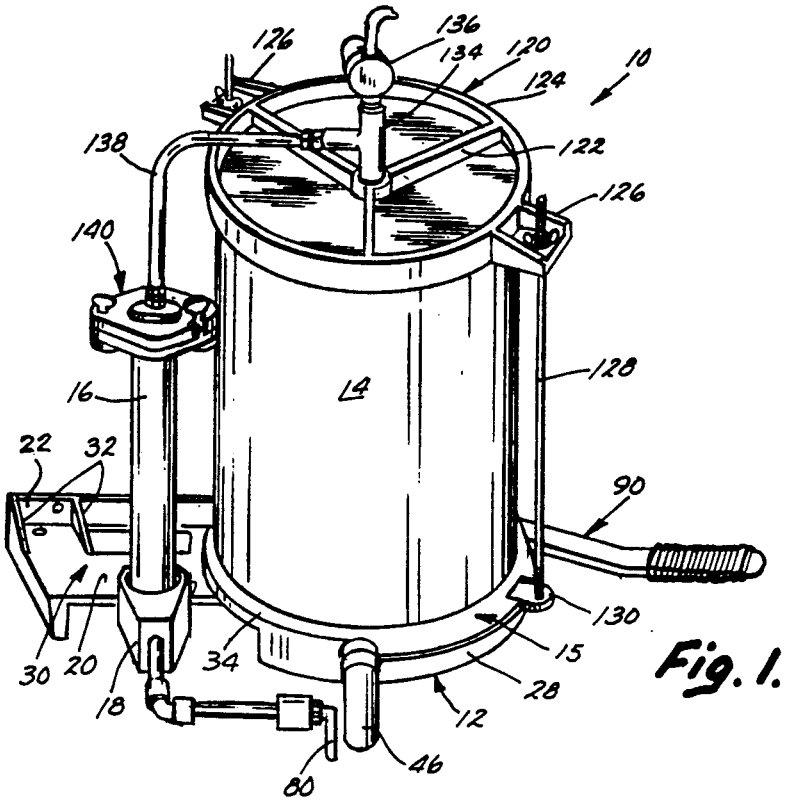
FIG. 1 is a perspective view of the dispensing apparatus of the present invention.
Figure 2:
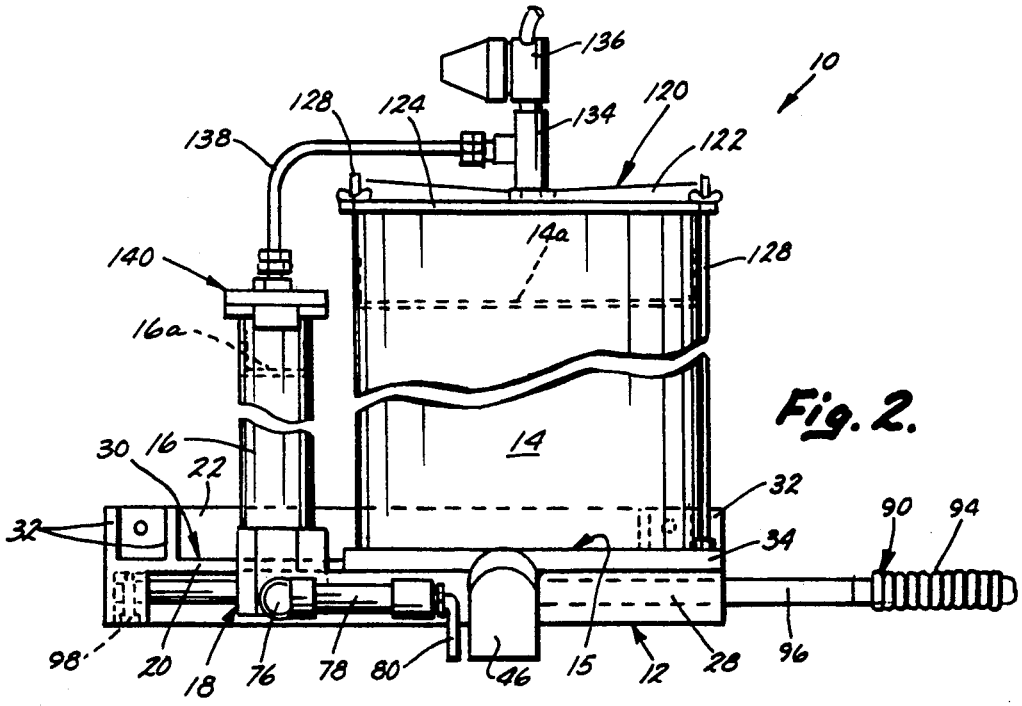
FIG. 2 is a broken, front elevation of the dispensing apparatus shown in FIG. 1.
Figure 3:
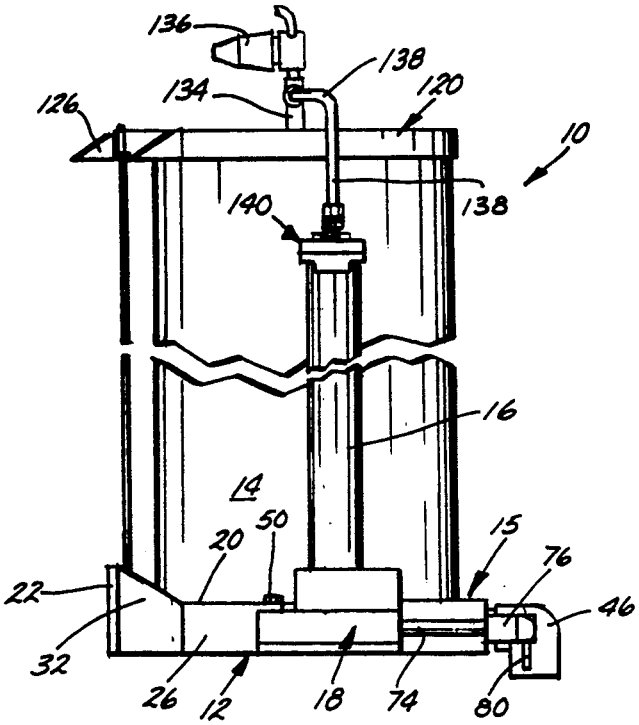
FIG. 3 is a broken, left side elevation of the dispensing apparatus of FIGS. 1 and 2.

Referring now to the drawings in greater detail, FIGS. 1-3 illustrate one embodiment 10 of the dispensing apparatus of the present invention. Dispenser 10 includes a base member 12, a first mounting portion or area 15 at one end of base 12 for a cylindrical container 14 of fluid material such as resin and a second mounting member or portion 18 for a smaller tubular container 16 of fluid material such as hardener or catalyst. Mounting member 18 is adjustably secured to the other end portion 20 of base member 12. A handle 90 is pivotally secured to the base member such that measuring pistons 108, 112 (FIGS. 4 and 5) may receive and force precise, predetermined quantities of each of the two fluids from containers 14, 16 through outlets 80 and 47 simultaneously. Preferably, air pressure is provided through a regulator 136 at the top of cylinder 14 and air lines 134 and 138 into cylinders 14, 16 to help urge the fluids from the containers.

As is best seen from FIGS. 1-5, base member 12 is preferably cast from aluminum alloy and includes a generally vertical peripheral flange having a rear portion 22, side portions 24, 26 and curved front portion 28. A generally planar platform or deck 30 extends horizontally and is supported generally intermediate the top and bottom of the peripheral flange and includes support or mounting area 15 for the larger cylindrical fluid cylinder 14 and the support area 20 to which the mounting member 18 for the second, smaller fluid cylinder 16 is adjustably secured. The positioning of platform 30 intermediate the height of the peripheral flange provides a hollow underspace or chamber below the platform in which handle 90 and the measuring pistons 108, 112, as well as portions of mounting member 18 and piston cylinder 40 which receives piston 112 ar included. Rear flange 22 is braced to platform 30 by means of four angled gussets 32.

Cylinder support area 15 is a generally planar, circular area at one end of platform 30 on base 12 and is defined by a circular ridge or shoulder 34 which confines cylinder 14. At the center of support area 15 is a circular aperture 36 (FIG. 4) surrounded by a shallow, circular groove which receives O-ring 38 providing a fluid-tight seal between area 15 and the bottom surface of the fluid cylinder 14 around aperture 36 when mounted thereon. Aperture 36 extends through platform 30 and communicates with the hollow cylindrical piston chamber 42 extending longitudinally along a piston cylinder 40 cast integrally with base 12 on the underside of deck 30 as shown in FIG. 5. Piston cylinder 40 extends outwardly of front flange 28 of base 12. Piston chamber 42 is threaded adjacent its front opening and receives a threaded nipple 44 and elbow 46 having a downwardly directed opening 47 providing a fluid outlet from piston chamber 42.

At the remaining end of base 12, support portion 20 of platform 30 includes an elongated slot 48 extending generally parallel to rear flange 22 adjacent the front edge of the platform. The peripheral flange extending around base 12 is omitted in the area adjacent slot 48 such that mounting member 18 for the second fluid cylinder 16 is received under slot 48 and secured by bolts 50 at various positions along the slot to allow adjustment of the position of the second cylinder and mounting member with respect to handle 90 and first cylinder support area 15.

Figure 9:
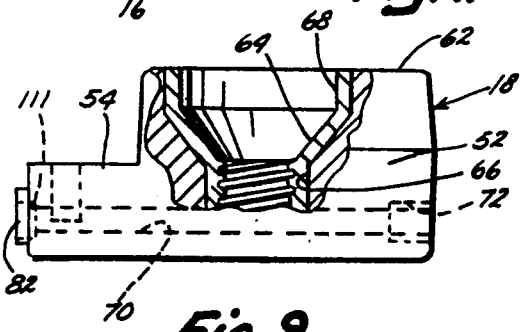
FIG. 9 is a side elevation shown partially in section of the mounting member for the fluid container shown in FIGS. 7 and 8.
Figure 10:
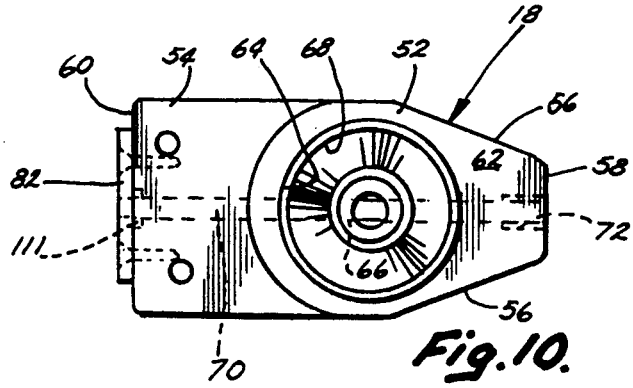
FIG. 10 is a top plan view of the mounting member for the fluid cylinder shown in FIG. 9.

With reference to FIGS. 9 and 10, fluid cylinder support member 18 is an elongated body having a raised front portion 52 and a rearwardly extending flange 54, both of which are integrally cast from aluminum alloy of the type used to form base 12. Sides 56 on the front portion 52 are angled inwardly toward one another such that front surface 58 is narrower than rear surface 60. The top surface 62 of front portion 52 includes a large circular bore 64 having an inwardly tapered lower portion leading to a narrower diameter neck 66. The entire bore and neck portions 64, 66 are lined with a layer of fast-cast rigid urethane material, typically three-sixteenths inch thick, the portion of which in neck 66 is formed to include threads receiving the threaded lower end of fluid cylinder 16. The rigid urethane layer provides a fluid-tight seal with the end of cylinder 66 and avoids the need for any O-ring or other separate sealing member.

Extending along the length of the entire mounting member 18 is a longitudinal bore 70 forming a piston cylinder or chamber communicating with the aperture and neck portion 64, 66 and thus with the fluid container 16 when mounted therein. The forward end 72 of bore 70 is threaded to receive pipe nipple 74 leading to an elbow 76, nipple 78 and elbow 80 providing an outlet for the fluid from cylinder 16 immediately adjacent outlet 47 in elbow 46 from cylinder 14. Since the mounting member 18 is formed from relatively soft aluminum alloy, a hardened reinforcement plate 82 is secured on the rear surface 60 of rear flange 54 by means of threaded fasteners and includes a through bore aligned with bore 70. Plate 82 thus serves as a guide and wear reinforcement for the cylindrical piston fitted therethrough as described hereinafter.

Figure 6:
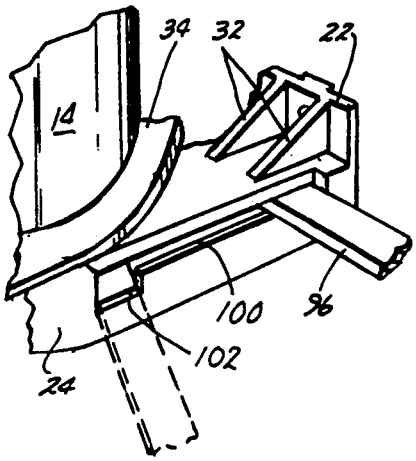
FIG. 6 is a fragmentary, perspective view of the handle guide on one end of the base member.
Figure 4:
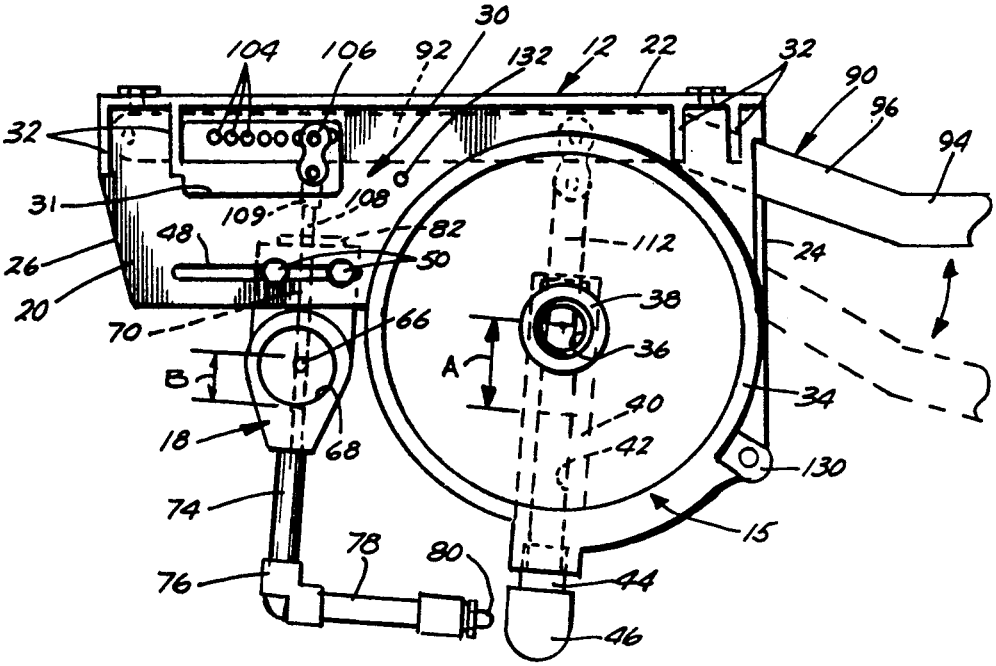
FIG. 4 is a top plan view of the base member for the dispensing apparatus of FIGS. 1-3 with the fluid containers and clamping apparatus removed.
Figure 5:
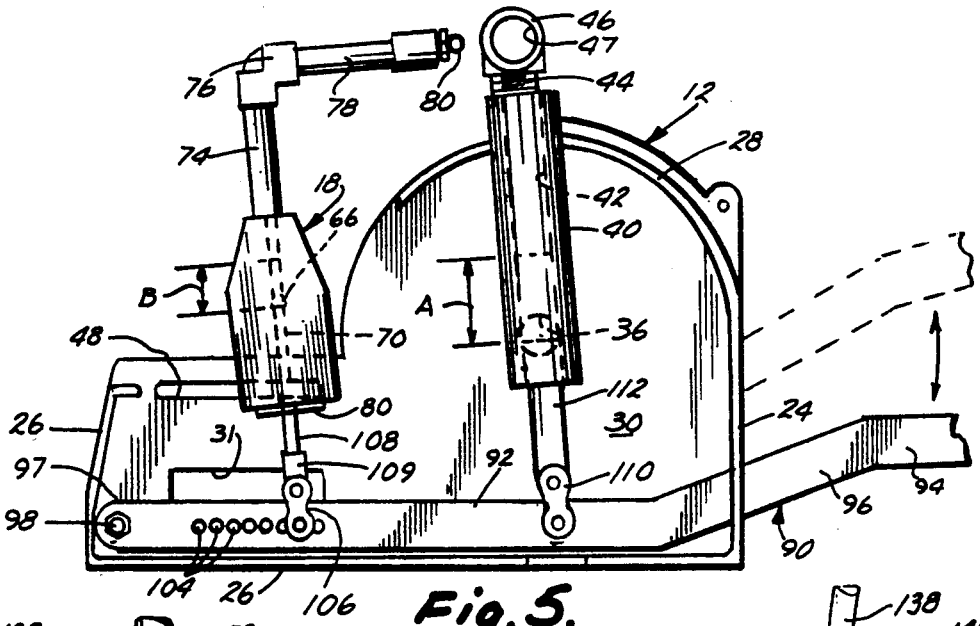
FIG. 5 is a bottom plan view of the base member of the dispensing apparatus shown in FIG. 4.
Figure 7:
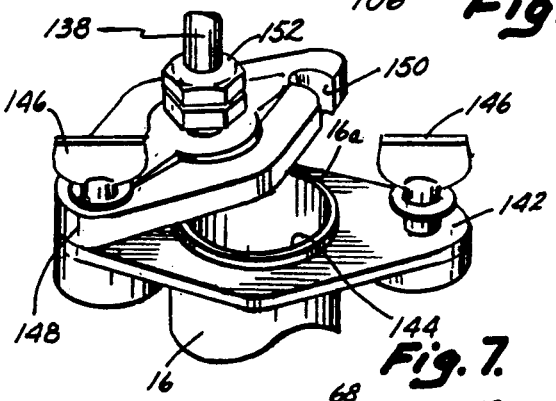
FIG. 7 is a perspective view of the top clamp for one of the fluid containers and shown in partially open position.

As shown in FIGS. 2, 4 and 5, manually operated metering handle 90, which is preferably cast from a higher tensile strength alloy of aluminum and zinc such as 3056 than is base 12, includes a pivot portion 92, a gripping area 94 and an angled, connecting portion 96 joining the two ends of the handle. The extreme end 97 of pivot portion 92 is pivotally secured beneath platform 30 immediately adjacent left side flange 26 by means of a pivot bolt 98. Connecting portion 96 is guided for horizontal movement about pivot bolt 98 by a generally horizontal guide slot 100 (FIG. 6) formed in right side flange 24. Slot 100 leads to an enlarged notch or detent 102 at the front end of the slot into which the handle drops when pulled forwardly as shown in FIGS. 4, 5 and 6. Notch 102 prevents undesired movement of the handle, and thus accidental dispensing of the fluids, until the handle is consciously raised and moved rearwardly.

Immediately adjacent pivoted end 97 of handle 90 on pivot portion 92 are a series of equally spaced apertures 104 adapted to receive the pivot pin of a master link 106 to pivotally connect the handle to the rear end of piston 108 which is slidably received in bore 70 of mounting member 18. Spaced at a distance greater than the distance from pivot 98 to connecting link 106 is a somewhat larger master connecting link 110 which pivotally connects pivot portion 92 of handle 90 to the rear end of piston 112 as shown in FIGS. 4 and 6. Piston 112 is slidably received in piston chamber 42 of piston cylinder 40 with a seal around the piston at the rear end thereof being provided by O-ring 113. Piston 108 is likewise sealed in bore 70 by O-ring 111 (FIGS. 4 and 5). Preferably, piston 112 is larger in diameter than piston 108, e.g., 0.750 inch versus 0.252 inch. Piston 112 is also preferably formed from polished steel rod while piston 108 includes an enlarged rear end 109 (FIGS. 4 and 5) allowing pivotal connection to link 106 and is preferably formed from Nylatron TM. The lengths of pistons 108, 112 are determined such that the forward ends of the pistons are in registry with apertures 66, 36, respectively, when handle 90, and thus pistons 108, 112, are moved rearwardly as shown in FIGS. 4 and 5. However, when grip 94 of handle 90 is grasped and pulled forwardly as shown, pistons 108, 112 are pushed forwardly in bore 70 and piston chamber 42 through distances B and A respectively. Preferably, piston 112 travels a distance A which is greater than distance B traveled by piston 108. Consequently, after fluids from containers 14 and 16 fill chambers 42 and bore 70 ahead of the pistons through apertures 36, 66, the forward movement of handle 90 will force a larger volume of fluid from outlet 47 than from outlet 80 because of the greater size of piston 112 as well as the greater distance A through which piston 112 travels as compared to distance B traveled by piston 108. However, the respective fluid quantities dispensed from the outlets 47, 80 always remain in the same proportions as long as the handle is moved along guide slot 100. Consequently, the fluid volumes dispensed are proportional to one another and repeated cyclically each time the handle is moved from rear to front.

Referring again to FIGS. 1-3, support area 15 is adapted to receive an upright, vertically oriented fluid cylinder 14 typically having formed cardboard or pressed paperboard sides and a stamped sheet metal lower end. With handle 90 pulled forwardly to move pistons 108, 112 past apertures 36, 66 thereby preventing fluid flow out of outlets 47, 80, the lower end of the cylinder may be punctured to form an aperture registering with aperture 36 and placed against support area 15 such that O-ring 38 seals the area around the adjacent apertures. Cylinder 14 is held against area 15 by means of a circular top clamp plate 120 preferably also cast from aluminum alloy and having radially outwardly extending reinforcing ribs 122 and a peripheral ridge 124. Ridge 124 extends downwardly below the planar bottom surface of plate 120 to confine the circular top edge of cylinder 14 when placed thereover. At diametrically opposed positions, clamping flanges 126 extend outwardly from ridge 124 and receive vertically extending tie rods 128 threadedly inserted in securing flange 130 on the forward side of base 12 and in aperture 132 toward the rear of base 12 (FIG. 4).

Figure 8:
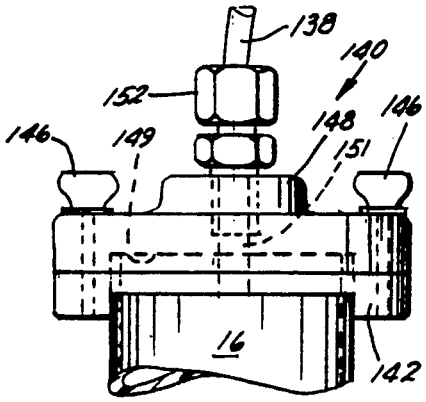
FIG. 8 is a fragmentary, front elevation of the top clamp for the fluid container shown in FIG. 7.

Top clamp plate 120 also includes a threaded aperture extending completely therethrough and communicating with the interior of cylinder 14 and receiving a T-shaped pipe nipple 134 on which an air pressure regulator 136 is mounted. As shown in FIGS. 1-3, 7 and 8, a flexible, polyethylene or other fluid line 138 leads from T nipple 134 and air regulator 136 on cylinder 14 to a top clamp assembly 140 at the top of fluid cylinder 16. Clamp assembly 140 includes a bottom clamp plate 142 preferably cast from aluminum alloy and having a central aperture 144 closely matched in size to the outside diameter of fluid cylinder 16. Fluid cylinder 16 preferably includes an enlarged rim **16*a* at its upper end which seats against the generally planar upper surface of bottom clamp plate 142. Thumbscrews 146 are received at either end of the plate 142. A top clamp plate 148, also preferably cast from aluminum alloy, is pivotally secured to one end of bottom clamp plate 142 by one of thumbscrews 146 received through an aperture at one end of the top clamp plate. As shown in FIG. 8, the underside of plate 148 includes a circular recess 149 which receives rim 16*a*. A central aperture 151 extends through plate 148 and receives a threaded connection 152 holding fluid line 138 in the clamp assembly. At the opposite end of plate 148 is a slot 150 having an open side adapted to slide around the other thumbscrew 146 such that the top plate may be aligned over bottom clamp plate 142 and securely tightened against rim 16*a* and plate 142 to form a fluid-tight seal around the top of cylinder 16. Thus, when fluid line 138 is secured to the top plate 148 and plates 142, 148 are clamped together around the top of cylinder 16, pressurized air from nipple 134 and air regulator 136 is fed to the interior of cylinder 16 simultaneously with the feeding of such pressurized air to the interior of cylinder 14 through top plate 120**.

OPERATION

Use and operation of the dispensing apparatus for multiple fluids will now be apparent. Base member 12 is positioned on a horizontal support surface or, alternately, affixed to a vertical wall or other support by means of fasteners passed through apertures provided in rear flange 22. Handle 90 is moved forwardly to its forwardmost position in slot 100 to engage notch 102 such that pistons 108, 112 extend past apertures 36, 66 to close piston chamber 42 and bore 70 and outlets 47, 80. Fluid cylinder 14 having a central aperture preformed in its bottom end is placed over mounting surface 15 such that its aperture registers with aperture 36. O-ring 38 provides a fluid-tight seal between the bottom surface of the fluid cylinder and mounting area 15 around aperture 36. Top clamp plate 120 is placed over the upper edge of cylinder 14 and tie rods 128 are threadedly secured such that ridge 124 confines the upper edge of the cylinder and forms a fluid-tight seal against the bottom surface of plate 120. Cylinder 14 includes a follower plate 14*a* which engages and follows the top surface of the fluid within the container. Thereafter, a second but smaller fluid cylinder or tube 16, having a similar follower plate 16*a*, is passed through the central aperture 144 in bottom clamp plate 142 of clamp assembly 140. The lower end of cylinder 16 is next threadedly secured in neck 66 and bore 64 of mounting member 18 as described above. Top clamp plate 148 is then secured over rim 16*a* of tube 16 by means of thumbscrews 146 such that a fluid-tight seal is provided for the air entering the clamp assembly and tube 16 from flexible fluid line 138. Typically, fluid cylinder 16, which is of smaller diameter than fluid cylinder 14, will include a catalyst or hardener which forms a chemical reaction when mixed with resin from fluid cylinder 14 to produce a filler, adhesive, putty, or laminating, potting or molding compound used for filling auto bodies, boat hulls or the like.

Once fluid cylinders 14, 16 have been securely mounted on support area 15 and mounting member 18 as described above, the desired proportions of the two fluids to be dispensed through outlets 47, 80 are determined. With the known proportions, the position of the pivotal connection of piston 108 is determined and one of the series of apertures 104 in handle portion 92 is selected. Master link 106 may be removed and inserted in the desired aperture through rectangular aperture 31 extending through platform 30 of base member 12. Once the appropriate aperture 104 is selected for pivotal connection of piston 108, bolts 50 are loosened and mounting member 18 slidably adjusted along the length of slot 48 such that guide plate 82 is substantially perpendicular to the longitudinal axis of piston 108. In this regard, the apertures 51 receiving bolts 50 in mounting member 18 are unequally spaced from rear surface 60 such that the mounting member will rest at an angle to slot 48 and rear flange 22 and generally parallel to the longitudinal extent of piston chamber 42 under support area 15. Bolts 50 are then retightened to hold the mounting member 18 in its adjusted position. The bore 70 and piston chamber 42 receiving pistons 108, 112 respectively extend generally parallel to one another but at a slight angle to the rear flange 22 in order to match the arc through which handle 90 moves as it is moved between its closed and opened positions. Preferably, apertures 104 are spaced equidistantly with a sufficient number provided so that the proportion of fluid dispensed from outlet 80 and fluid cylinder 16 changes by approximately one-quarter of 1% by moving the pivotal connection of piston 108 to the next adjacent aperture. As shown in FIG. 4, sufficient apertures 104 are provided so that the adjustment range of fluid from cylinder 16, preferably hardener, can range from 1-2% by volume with respect to the quantity of fluid from cylinder 14 dispensed by piston 112. Depending on the densities of the fluids to be dispensed, and the quantity of fluid from cylinder 16 with respect to the fluid from cylinder 14 which is desired, the appropriate aperture 104 is selected.

Once the above adjustments have been made, pressurized air is admitted to the top of cylinders 14 and 16 through air regulator 136, T nipple 134 and flexible fluid line 138. Preferably, air regulator 136 is that sold under Model No. R14 by Norgren Sales Company of Detroit, Mich. and provides a consistent nine psi of filtered air pressure into cylinders 14 and 16. Normally, air available in most industrial settings is available at 90 psi which is too great a pressure to operate against cylinders 14, 16. The air pressure entering the cylinders acts against follower plates 14*a*, 16*a* and urges fluid within the cylinders into apertures 36, 66 as described above.

When dispensing of predetermined quantities of fluids from cylinders 14, 16 is desired, handle 90 is lifted out of notch 102 by means of grip 94 and slid rearwardly along guide slot 100. This withdraws pistons 108, 112 until their forward ends are in registry with apertures 36, 66 and the air pressure acting against follower plates 14*a*, 16*a* forces fluid into piston chamber 42 and bore 70 ahead of the respective pistons. Air regulator 136 is set to provide pressure sufficiently low to prevent direct dispensing of fluid through bores 42, 70 without operation of the pistons. Thereafter, grip 94 of handle 90 is grasped and pulled forwardly until handle 90 drops into notch 102 which simultaneously slides pistons 108, 112 forwardly through distances B and A respectively and forces the fluid contained within bore 70 and chamber 42 along the distances B and A and out of outlets 80, 47 respectively. Simultaneously, the movement of the pistons closes off apertures 36, 66 to prevent further fluid from entering bore 70 and chamber 42 during the dispensing of the predetermined quantities. Should additional proportionate quantities of fluids from cylinders 14, 16 be desired, the handle is again grasped, lifted, moved rearwardly and again pulled forwardly to provide such additional quantities.

As will now be understood, it is also possible to provide a series of connecting apertures adjacent one another near connecting master link 110 such that the distance traveled by piston 112 could likewise be adjusted in the same manner as for piston 108. Likewise, other variations of connections and adjustments along the length of handle 90 may be used to adjust the amount of travel of the sliding pistons. Further, depending on the viscosity and density of the fluid to be dispensed using the apparatus, it is possible to eliminate the use of air pressure acting against follower plates 14*a*, 16*a* within the cylinders while still allowing the fluid to flow downwardly into apertures 36, 66 for dispensing purposes.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. A dispenser for dispensing multiple fluids in proportion to one another comprising:

a base having first and second fluid outlets, first mounting means for mounting a first fluid container in fluid communication with said first outlet, and second mounting means for mounting a second fluid container in fluid communication with said second outlet;

manually operated metering means on said base for dispensing predetermined proportioned quantities of first and second fluids through said first and second outlets, said metering means including a handle movably mounted on said base, first and second measuring means each connected to said handle and in fluid communication with said respective outlets for measuring and dispensing quantities of first and second fluids through said first and second outlets upon movement of said handle;

pressure means for applying pressure to fluids in the first and second fluid containers when mounted on said mounting means to urge fluid from each container to said respective measuring means; and adjustment means for changing the connection position of at least one of said measuring means to said handle whereby the proportion of one of said dispensed fluids to the other fluid may be varied.

2. The dispenser of claim 1 wherein said one measuring means is mounted on one of said first and second mounting means; said adjustment means including fastening means for securing said one of said first and second mounting means to said base in different positions with respect to said handle.

3. The dispenser of claim 2 wherein said pressure means includes a flexible fluid pressure line extending between said first and second mounting means to allow said one of said first and second mounting means to be secured in different positions.

4. The dispenser of claim 2 wherein said first measuring means is mounted on said first mounting means and said second measuring means is mounted on said second mounting means; said one measuring means being said second measuring means.

5. The dispenser of claim 4 wherein a first portion of said handle is pivotally mounted to said base; said first and second measuring means being pivotally connected to said handle at different distances from said first handle portion.

6. The dispenser of claim 5 wherein said first and second measuring means are each connected to said handle intermediate said first handle portion and one end of said handle; said second measuring means being connected to said handle at a position closer to said first handle portion than the position at which said first measuring means is connected to said handle.

7. The dispenser of claim 6 wherein said first mounting means includes a first piston cylinder having an opening to the first fluid container and communicating with said first outlet; said second mounting means including a second piston cylinder having an opening to the second fluid container and communicating with said second outlet; and first and second pistons slidably mounted respectively in said first and second piston cylinders, said pistons each being pivotally connected to said handle and adapted to each push a predetermined quantity of fluid from said respective opening out of said respective fluid outlet upon movement of said handle.

8. The dispenser of claim 2 wherein said adjustment means includes a series of apertures in said handle for pivotally connecting said one of said measuring means.

9. The dispenser of claim 8 wherein said fastening means includes a slot and at least one fastener extending through said slot and securing said one of said first and second mounting means to said base whereby the position of said one of said first and second mounting means is adjustable along said slot.

10. The dispenser of claim 1 wherein said first and second measuring means are each connected to said handle intermediate said first handle portion and one end of said handle; said second measuring means being connected to said handle at a position closer to said first handle portion than the position at which said first measuring means is connected to said handle.

11. The dispenser of claim 10 wherein a first portion of said handle is pivotally mounted to said base; said first and second measuring means being pivotally connected to said handle at different distances from said first handle portion.

12. The dispenser of claim 1 wherein said adjustment means includes a series of apertures in said handle for pivotally connecting said one of said measuring means.

13. The dispenser of claim 1 wherein said first mounting means includes a fluid cylinder receiving area on said base for receiving the bottom of a fluid cylinder, a top clamp plate for engaging the top of a fluid cylinder, and at least one tie rod for securing said top clamp plate against the fluid cylinder when mounted on said fluid cylinder receiving area.

14. The dispenser of claim 13 wherein said fluid cylinder receiving area includes an aperture communicating with said first measuring means, and sealing means around said aperture for providing a fluid-tight seal between said cylinder receiving area and a fluid cylinder when mounted thereon; said pressure means including means for attaching a fluid pressure line to said top clamp plate when a fluid cylinder is mounted over said aperture.

15. The dispenser of claim 13 wherein said pressure means includes an air regulator mounted on said top clamp plate and fluid line means for connecting said air regulator to the first and second fluid cylinders when mounted on said first and second mounting means.

16. The dispenser of claim 1 wherein said second mounting means includes an aperture in fluid communication with said second measuring means, securing means for securing a fluid cylinder over said aperture, and fluid-tight clamp means for attaching a fluid pressure line from said pressure means to the top of the fluid cylinder when mounted over said aperture.

17. The dispenser of claim 16 wherein said second mounting means is separate from said base; said adjustment means also including a slot and at least one fastener extending through said slot for securing said second mounting means to said base whereby the position of said second mounting means is adjustable along said slot.

18. The dispenser of claim 1 wherein said pressure means includes an air regulator and fluid line means for connecting said air regulator to the first and second fluid cylinders when mounted on said first and second mounting means.

19. The dispenser of claim 1 wherein said base includes a guide surface for guiding movement of said handle and a notch for receiving said handle in one position to prevent accidental movement of the handle.

20. A dispenser for dispensing multiple fluids in proportion to one another comprising:

a base having first and second fluid outlets, first mounting means for mounting a first fluid container in fluid communication with said first outlet, and second mounting means for mounting a second fluid container in fluid communication with said second outlet;

manually operated metering means on said base for dispensing predetermined proportioned quantities of first and second fluids through said first and second outlets, said metering means including a manually operated metering handle, pivot means for pivotally mounting a first portion of said handle on said base, a second portion of said handle which is spaced from said first portion being adapted to be grasped for moving said handle between at least two positions with respect to said base, first and second measuring means on said base for measuring and dispensing quantities of first and second fluids through said respective first and second outlets upon movement of said handle, each of said measuring means being pivotally connected to said handle intermediate said first and second handle portions, said first measuring means being in fluid communication with said first outlet and second measuring means being in fluid communication with said second outlet; and adjustment means for changing the connection position of at least one of said measuring means to said handle whereby the proportion of one of said dispensed fluids to the other fluid may be varied.

21. The dispenser of claim 20 wherein said one of said measuring means is said second measuring means which is pivotally connected to said handle at a position closer to said first handle portion than said first measuring means.

22. The dispenser of claim 21 wherein said first mounting means is adapted to receive a cylinder of fluid resin while said second mounting means is adapted to receive a cylinder of fluid hardener for said resin.

23. The dispenser of claim 21 wherein said first mounting means includes a first piston cylinder having an opening to the first fluid container and communicating with said first outlet; said second mounting means including a second piston cylinder having an opening to the second fluid container and communicating with said second outlet; and first and second pistons slidably mounted respectively in said first and second piston cylinders, said pistons each being pivotally connected to said handle and adapted to each push a predetermined quantity of fluid from said respective opening out of said respective fluid outlet upon movement of said handle.

24. The dispenser of claim 21 wherein said one measuring means is mounted on one of said first and second mounting means; said adjustment means including fastening means for securing said one of said first and second mounting means to said base in different positions with respect to said handle.

25. The dispenser of claim 20 wherein said first mounting means includes a first piston cylinder having an opening to the first fluid container and communicating with said first outlet; said second mounting means including a second piston cylinder having an opening to the second fluid container and communicating with said second outlet; and first and second pistons slidably mounted respectively in said first and second piston cylinders, said pistons each being pivotally connected to said handle and adapted to each push a predetermined quantity of fluid from said respective opening out of said respective fluid outlet upon movement of said handle.

26. The dispenser of claim 20 wherein said one measuring means is mounted on one of said first and second mounting means; said adjustment means including fastening means for securing said one of said first and second mounting means to said base in different positions with respect to said handle.

27. The dispenser of claim 20 wherein said adjustment means includes a series of apertures in said handle for pivotally connecting said one of said measuring means.

28. The dispenser of claim 27 wherein said second mounting means is separate from said base; said adjustment means also including a slot and at least one fastener extending through said slot for securing said second mounting means to said base whereby the position of said second mounting means is adjustable along said slot.

29. The dispenser of claim 20 wherein said second mounting means is separate from said base; said adjustment means also including a slot and at least one fastener extending through said slot for securing said second mounting means to said base whereby the position of said second mounting means is adjustable along said slot.

30. The dispenser of claim 20 wherein said first mounting means includes a fluid cylinder receiving area on said base for receiving the bottom of a fluid cylinder, a top clamp plate for engaging the top of a fluid cylinder, and at least one tie rod for securing said top clamp plate against the fluid cylinder when mounted on said fluid cylinder receiving area.

31. The dispenser of claim 30 wherein said fluid cylinder receiving area includes an aperture communicating with said first measuring means, and sealing means around said aperture for providing a fluid-tight seal between said cylinder receiving area and a fluid cylinder when mounted thereon.

32. The dispenser of claim 20 wherein said second mounting means includes an aperture in fluid communication with said second measuring means and securing means for securing a fluid cylinder over said aperture.

33. The dispenser of claim 20 wherein said base includes a guide surface for guiding movement of said handle and a notch for receiving said handle in one position to prevent accidental movement of the handle.

34. A dispenser for dispensing multiple fluids in proportion to one another comprising:

a base having first and second fluid outlets, first mounting means for mounting a first fluid container in fluid communication with said first outlet, and second mounting means for mounting a second fluid container in fluid communication with said second cutlet;

manually operated metering means on said base for dispensing predetermined proportioned quantities of and second fluids through said first and second outlets, said metering means including a handle movably mounted on said base and first and second measuring means each engaging said handle and in fluid communication with said respective outlets for measuring and dispensing quantities of first and second fluids through said first and second outlets upon movement of said handle;

said first measuring means being mounted on said first mounting means; said second measuring means being mounted on said second mounting means; and at least one of said first and second mounting means including fastening means for securing said one of said first and second mounting means to said base in different positions with respect to said handle such that the position of engagement of said one of said first and second mounting means with said handle is adjustable to vary the proportion of one of said dispensed fluids to the other fluid.

35. The dispenser of claim 34 also including adjustment means for changing the engagement position of at least one of said measuring means with said handle.

36. The dispenser of claim 35 wherein said adjustment means includes a series of apertures in said handle for pivotally connecting said one of said measuring means.

37. The dispenser of claim 34 wherein said fastening means includes a slot and at least one fastener extending through said slot and securing said one of said first and second mounting means to said base whereby the position of said one of said first and second mounting means is adjustable along said slot.

38. The dispenser of claim 37 wherein said one of said first and second mounting means is said second mounting means; said first mounting means being adapted to receive a cylinder of fluid resin while said second mounting means is adapted to receive a cylinder of fluid hardener for said resin.

39. The dispenser of claim 34 including pressure means for applying pressure to the fluids in the first and second fluid containers when mounted on said mounting means to urge fluid from each container to said respective measuring means.

40. The dispenser of claim 39 wherein said pressure means includes an air regulator and fluid line means for connecting said air regulator to the first and second fluid cylinders when mounted on said first and second mounting means.

41. The dispenser of claim 34 wherein a first portion of said handle is pivotally mounted to said base; said first and second measuring means being pivotally connected to said handle at different distances from said first handle portion.

42. The dispenser of claim 41 wherein said first and second measuring means are each connected to said handle intermediate said first handle portion and one end of said handle; said second measuring means being connected to said handle at a position closer to said first handle portion than the position at which said first measuring means is connected to said handle.

43. The dispenser of claim 42 wherein said first mounting means includes a first piston cylinder having an opening to the first fluid container and communicating with said first outlet; said second mounting means including a second piston cylinder having an opening to the second fluid container and communicating with said second outlet; and first and second pistons slidably mounted respectively in said first and second piston cylinders, said pistons each being pivotally connected to said handle and adapted to each push a predetermined quantity of fluid from said respective opening out of said respective fluid outlet upon movement of said handle.

44. The dispenser of claim 34 wherein said first mounting means includes a fluid cylinder receiving area on said base for receiving the bottom of a fluid cylinder, a top clamp plate for engaging the top of a fluid cylinder, and at least one tie rod for securing said top clamp plate against the fluid cylinder when mounted on said fluid cylinder receiving area.

45. The dispenser of claim 44 wherein said fluid cylinder receiving area includes an aperture communicating with said first measuring means, and sealing means around said aperture for providing a fluid-tight seal between said cylinder receiving area and a fluid cylinder when mounted thereon.

46. The dispenser of claim 34 wherein said second mounting means includes an aperture in fluid communication with said second measuring means and securing means for securing a fluid cylinder over said aperture.

47. The dispenser of claim 34 wherein said base includes a guide surface for guiding movement of said handle and a notch for receiving said handle in one position to prevent accidental movement of the handle.

* * * * *

UNITED STATES PATENT AND TRADEMARK OFFICE

CERTIFICATE OF CORRECTION

PATENT NO. : 5,139,170

DATED : August 18, 1992

INVENTOR(S) : Richard E. Bullock

It is certified that error appears in the above-identified patent and that said Letters Patent is hereby corrected as shown below:

Column 4, line 8:

"112 ar" should be --112 are--;

Column 12, line 52:

Before "and second" (first occurence) insert --first--.

Signed and Sealed this

Nineteenth Day of October, 1993

*Attest:*

*Attesting Officer*

BRUCE LEHMAN

*Commissioner of Patents and Trademarks*